US005876909A

United States Patent [19]

Hershey et al.

[11] Patent Number: 5,876,909

[45] Date of Patent: Mar. 2, 1999

[54] INFRARED SENSOR DETECTABLE RADIOGRAPHIC ELEMENTS CONTAINING VERY THIN TABULAR GRAIN EMULSIONS

[75] Inventors: Stephen A. Hershey, Fairport; James C. Bolthouse, Spencerport; Robert E. Dickerson, Hamlin, all of N.Y.

[73] Assignee: Eastman Kodak Company, Rochester, N.Y.

[21] Appl. No.: 934,177

[22] Filed: Sep. 19, 1997

[51] Int. Cl.[6] ..... G03C 1/76; G03C 5/16

[52] U.S. Cl. ..... 430/513; 430/510; 430/567; 430/944; 430/963; 430/966

[58] Field of Search ..... 430/510, 567, 430/944, 963, 966, 513

[56] References Cited

U.S. PATENT DOCUMENTS 4,414,304 11/1983 Dickerson ..... 430/353

5,260,178 11/1993 Harada et al. ..... 430/508

5,637,447 6/1997 Dickerson et al. ..... 430/567

5,773,206 6/1998 Hershey et al. ..... 430/510

*Primary Examiner*—Mark F. Huff

*Attorney, Agent, or Firm*—Carl O. Thomas

[57] ABSTRACT

The problem of sensing the presence of radiographic elements using infrared sensors that occurs when a radiographic element contains one or more very thin tabular grain emulsions a total silver coating coverage of less than 30 mg/dm$^2$ is addressed by placing particles in one or more non-emulsion hydrophilic colloid layers. The particles are removable during rapid access processing, have a mean equivalent circular diameter of from 0.3 to 1.1 $\mu$m, and have an index of refraction at the wavelength of the infrared radiation that differs from the index of refraction of the hydrophilic colloid by at least 0.2.

10 Claims, No Drawings

INFRARED SENSOR DETECTABLE RADIOGRAPHIC ELEMENTS CONTAINING VERY THIN TABULAR GRAIN EMULSIONS

FIELD OF THE INVENTION

The invention pertains to radiographic elements containing radiation-sensitive silver halide intended to form silver images when imagewise exposed and subjected to rapid access processing.

DEFINITIONS

The term "radiographic element" is employed to designate an element capable of producing a viewable silver image upon (a) imagewise direct or indirect exposure to X-radiation or digital exposure to recreate an image pattern of X-radiation exposure followed by (b) rapid access processing.

The terms "rapid access processing" and "rapid access processor" are employed to indicate a capability of providing dry-to-dry processing in 90 seconds or less. The term "dry-to-dry" is used to indicate the processing cycle that occurs between the time a dry, imagewise exposed element enters a processor to the time it emerges, developed, fixed and dry.

In referring to silver halide grains or emulsions containing two or more halides, the halides are named in order of ascending concentrations.

The terms "high bromide" and "high chloride" in referring to silver halide grains and emulsions indicate greater than 50 mole percent bromide or chloride, respectively, based on total silver.

The term "equivalent circular diameter" or "ECD" indicates the diameter of a circle having an area equal to the projected area of a grain or particle.

The term "size" in referring to grains and particles indicates, unless otherwise described, indicates ECD.

The term "aspect ratio" designates the ratio of grain ECD to grain thickness (t).

The term "tabular grain" indicates a grain having two parallel crystal faces which are clearly larger than any remaining crystal faces and having an aspect ratio of at least 2.

The term "very thin" in referring to tabular grains indicates a thickness of 0.10 $\mu$m or less and in referring to tabular grain emulsions indicates an average tabular grain thickness of 0.10 $\mu$m or less.

The term "compact" in referring to grains and particles indicates an aspect ratio of less than 2.

The term "dual-coated" refers to an element that has radiation-sensitive emulsion layers coated on both sides of a support.

The terms "front" and "back" refer to the sides of the element oriented nearer or farther, respectively, from the source of exposing radiation than the support. When an element is exposed concurrently to light and X-radiation, "front" and "back" are referenced to the X-radiation. One layer is "behind" another, when it is located to receive exposing radiation subsequent to another layer.

The term "specular density" refers to the density an element presents to a perpendicularly intersecting beam of radiation where penetrating radiation is collected within a collection cone having a half angle of less than 10°, the half angle being the angle that the wall of the cone forms with its axis, which is aligned with the beam. For a background description of density measurement, attention is directed to Thomas, *SPSE Handbook of Photographic Science and Engineering*, John Wiley & Sons, New York, 1973, starting at p. 837.

*Research Disclosure* is published by Kenneth Mason Publications, Ltd., Dudley House, 12 North St., Emsworth, Hampshire P010 7DQ, England.

BACKGROUND

Radiographic elements can serve a variety of imaging applications, but are most extensively employed in medical diagnostic imaging. The radiographic elements produce viewable silver images upon imagewise exposure followed by rapid access processing.

Roentgen discovered X-radiation by the inadvertent exposure of a silver halide photographic element. The discovery led to medical diagnostic imaging. In 1913 the Eastman Kodak Company introduced its first product specifically intended to be exposed by X-radiation. Shortly thereafter it was discovered that the films could be more efficiently employed in combination with one or two intensifying screens. An intensifying screen is relied upon to capture an image pattern of X-radiation and emit light that exposes the radiographic element. Elements that rely entirely on X-radiation absorption for image capture are referred to as direct radiographic elements, while those that rely on intensifying screen light emission, are referred to as indirect radiographic elements. Silver halide radiographic elements, particularly indirect radiographic elements, account for the overwhelming majority of medical diagnostic images.

In recent years a number of alternative approaches to medical diagnostic imaging, particularly image acquisition, have become prominent. Medical diagnostic devices such as storage phosphor screens, CAT scanners, magnetic resonance imagers (MRI), and ultrasound imagers allow information to be obtained and stored in digital form. Although digitally stored images can be viewed and manipulated on a cathode ray tube (CRT) monitor, a hard copy of the image is almost always needed.

The most common approach for creating a hard copy of a digitally stored image is to expose a radiation-sensitive silver halide film through a series of laterally offset exposures using a laser, a light emitting diode (LED) or a light bar (a linear series of independently addressable LED's). The image is recreated as a series of laterally offset pixels. Initially the radiation-sensitive silver halide films were essentially the same films used for radiographic imaging, except that finer silver halide grains were substituted to minimize noise (granularity). The advantages of using modified radiographic films to provide a hard copy of the digitally stored image are that medical imaging centers are already equipped for rapid access processing of radiographic films and are familiar with their image characteristics.

Rapid access processing can be illustrated by reference to the Kodak X-OMAT M6A-N™ rapid access processor, which employs the following (reference) processing cycle:

development 24 seconds at 35° C.

fixing 20 seconds at 35° C.

washing 20 seconds at 35° C.

drying 20 seconds at 65° C.

with up to 6 seconds being taken up in film transport between processing steps.

A typical developer employed in this processor exhibits the following composition:

hydroquinone 30 g 1-phenyl-3-pyrazolidone 1.5 g

KOH 21 g $NaHCO_3$ 7.5 g $K_2SO_3$ 44.2 g $Na_2S_2O_3$ 12.6 g

NaBr 35.0 g 5-methylbenzotriazole 0.06 g glutaraldehyde 4.9 g water to 1 liter at a pH 10.0.

A typical fixer employed in this processor exhibits the following composition:

$Na_2S_2O_3$ in water at 60% of total weight in water 260.0 g $NaHSO_3$ 180.0 g boric acid 25.0 g acetic acid 10.0 g water to 1 liter at a pH of 3.9–4.5. Numerous variations of the reference processing cycle (including, shorter processing times and varied developer and fixer compositions) are known.

Rapid access processors are typically activated when an imagewise exposed element is introduced for processing. Silver halide grains in the element interrupt an infrared sensor beam in the wavelength range of from 850 to 1100 nm, typically generated by a photodiode. The silver halide grains reduce density of infrared radiation reaching a photosensor, telling the processor that an element has been introduced for processing and starting the rapid access processing cycle. Once silver halide grains have been developed, developed silver provides the optical density necessary to interact with the infrared sensors. When the processed element emerges from the processor, an infrared sensor placed near the exit of the processor receives an uninterrupted infrared beam and shuts down the processor until another element is introduced requiring processing.

Highly advantageous silver halide emulsions for forming silver images in radiographic elements are tabular grain emulsions. Among their many advantages, tabular grain emulsions exhibit high levels of covering power (the ratio of maximum density divided by silver coating coverage), as illustrated by Dickerson U.S. Pat. No. 4,414,304. The covering power of tabular grain emulsions increases as the mean thickness of the tabular grains decreases. The high covering power of very thin (0.10 $\mu$m or less) tabular grain emulsions allows them to be coated in radiographic elements at silver coverages of less than 30 mg/dm$^2$. The low silver coating coverages in turn allow radiographic element constructions that can be processed in less than 45 seconds and even less than 30 seconds.

While lower silver coating coverages are in themselves advantageous in saving materials and facilitating rapid access processing, the low silver coverages have presented a problem in using commercially available rapid access processors, since they lack sufficient infrared density to be detected by the sensor beams used to sense the presence of radiographic film in rapid access processors.

Harada et al U.S. Pat. No. 5,260,178 has noted that with low silver coating coverages in radiographic elements, it is impossible for sensors that rely on the scattering of near infrared sensor beams by silver halide grains to sense the presence of the film in the processor. The solution proposed is to incorporate an infrared absorbing dye. Instead of reducing specular density by scattering near infrared radiation, the dye simply absorbs the near infrared radiation of the sensor beam. During processing the dye is deaggregated to shift its absorption peak. In the later stages of processing the density of developed silver is relied upon for interrupting sensor beams, which is the conventional practice.

The difficulty with the Harada et al solution to the problem of insufficient silver halide grain coating coverages to activate infrared sensors is that it relies on the addition of a complex organic material—specifically a tricarbocyanine dye that must have, in addition to the required chromophore for near infrared absorption, a steric structure suitable for aggregation and solubilizing substituents to facilitate deaggregation. The dyes of Harada et al also present the problem of fogging the radiation-sensitive silver halide grains when coated in close proximity, such as in a layer contiguous to a radiation-sensitive emulsion layer. Simply stated, the burden of the "cure" that Harada proposes is sufficiently burdensome as to entirely offset the advantage of reduced silver coating coverages, arrived at by years of effort by those responsible for improving films for producing silver images in response to rapid access processing. Thus, Harada's film structure modification is not a problem solution that has practical appeal.

RELATED APPLICATION

Hershey et al U.S. Ser. No. 08/840,517, filed Apr. 21, 1997, now U.S. Pat. No. 5,773,206, titled INFRARED SENSOR DETECTABLE IMAGING ELEMENTS, discloses an element capable of forming a silver image containing insufficient radiation-sensitive silver halide grains to render the element detectable by an infrared sensor. The element has been modified to increase infrared specular density by the inclusion of, in a hydrophilic colloid dispersing medium, particles (a) removable from the element during a rapid access processing cycle, (b) having a mean size of from 0.3 to 1.1 $\mu$m and at least 0.1 $\mu$m larger than the mean grain size of the radiation-sensitive grains, and (c) having an index of refraction at the wavelength of the infrared radiation that differs from the index of refraction of the hydrophilic colloid by at least 0.2.

SUMMARY OF THE INVENTION

In one aspect, this invention is directed to a radiographic element comprised of a transparent film support and, coated on the support, hydrophilic colloid layers, including (a) one or more radiation-sensitive image forming tabular grain emulsion layers (i) having a mean grain equivalent circular diameter of greater than 0.6 $\mu$m, (ii) containing less than 3 mole percent iodide, based on silver, (iii) having a mean tabular grain thickness of 0.10 $\mu$m or less, and (iv) coated at a total silver coating coverage of less than 30 mg/dm$^2$, and (b) one or more other hydrophilic colloid layers, wherein the specular density of the element to infrared radiation in the wavelength range of from 850 to 1100 nm is increased by the presence of compact particles dispersed in at least one of the other hydrophilic colloid layers, said particles (a) being removable from the element during the reference processing cycle, (b) having a mean equivalent circular diameter of from 0.3 to 1.1 $\mu$m, and (c) having an index of refraction at the wavelength of the infrared radiation that differs from the index of refraction of the hydrophilic colloid by at least 0.2, the reference processing cycle consisting of development 24 seconds at 35° C.

fixing 20 seconds at 35° C.

washing 20 seconds at 35° C.

drying 20 seconds at 65° C.

with up to 6 seconds being taken up in film transport between processing steps, development employing the following composition:

hydroquinone 30 g 1-phenyl-3-pyrazolidone 1.5 g

KOH 21 g $NaHCO_3$ 7.5 g $K_2SO_3$ 44.2 g $Na_2S_2O_3$ 12.6 g

NaBr 35.0 g 5-methylbenzotriazole 0.06 g glutaraldehyde 4.9 g water to 1 liter at a pH 10.0, and fixing employing the following composition:

$Na_2S_2O_3$ in water at 60% of total weight 260.0 g $NaHSO_3$ 180.0 g boric acid 25.0 g acetic acid 10.0 g water to 1 liter at a pH of 3.9–4.5.

DESCRIPTION OF PREFERRED EMBODIMENTS

The present invention is generally applicable to increasing the specular density to near infrared radiation in the wavelength range of from 850 to 1100 nm of radiographic elements that rely for silver image formation on one or more radiation-sensitive very thin tabular grain emulsions coated at a total silver coating coverage of less than 30 mg/dm$^2$.

The specular density of the radiographic elements to infrared radiation in the wavelength range of from 850 to 1100 nm is increased by the presence of compact particles dispersed in at least one of the hydrophilic colloid layers. The particles have a mean ECD of from 0.3 to 1.1 $\mu$m and have an index of refraction at the wavelength of the infrared radiation that differs from the index of refraction of the hydrophilic colloid by at least 0.2. The particles are additionally chosen to be removable during rapid access processing, since they are no longer needed or desirable in the element after a silver image is developed in the element.

The following represents a support and layer arrangement compatible with radiographic elements satisfying the requirements of the invention:

| |
|---|
| Front Hydrophilic Colloid Layer Unit |
| Transparent Film Support |
| Back Hydrophilic Colloid Layer Unit |

(I)

While the transparent film support in its simplest form can consist of any flexible transparent film, it is common practice to modify the surfaces of radiographic film supports by providing subbing layers to promote the adhesion of hydrophilic colloids to the support. Any conventional radiographic film support can be employed. Radiographic film supports usually exhibit these specific features: (1) the film supports are constructed of polyesters to maximize dimensional integrity rather than employing cellulose acetate supports as are most commonly employed in photographic elements and (2) the film supports are blue tinted to contribute the cold (blue-black) image tone sought in the fully processed films. Colorless transparent film supports are also commonly used. Radiographic film supports, including the incorporated blue dyes that contribute to cold image tones, are described in *Research Disclosure*, Vol. 184, August 1979, Item 18431, Section XII. Film Supports. *Research Disclosure*, Vol. 389, September 1994, Item 38957, Section XV. Supports, illustrates in paragraph (2) suitable subbing layers to facilitate adhesion of hydrophilic colloids to the support. Although the types of transparent films set out in Section XV, paragraphs (4), (7) and (9) are contemplated, due to their superior dimensional stability, the transparent films preferred are polyester films, illustrated in Section XV, paragraph (8). Poly(ethylene terephthalate) and poly(ethylene naphthenate) are specifically preferred polyester film supports.

It is conceptually possible to construct the front hydrophilic colloid layer unit of a single hydrophilic colloid layer containing one or more very thin tabular grain emulsions—i.e., a single radiation-sensitive image forming tabular grain silver halide emulsion layer. In practice, the front hydrophilic colloid layer unit more typically exhibits the following structure:

| |
|---|
| Surface Overcoat |
| Interlayer |
| Radiation-sensitive Emulsion Layer(s) |

(FHCLU-I)

Similarly, the back hydrophilic colloid layer unit can consist of a single hydrophilic colloid layer, but, preferably, the back hydrophilic colloid layer unit is also formed of a plurality of hydrophilic colloid layers.

When the radiation-sensitive image forming emulsion or emulsions are confined to the front hydrophilic colloid layer unit, the following represents a typical preferred back hydrophilic colloid layer unit:

| |
|---|
| Pelloid |
| Interlayer |
| Surface Overcoat |

(BHCLU-I)

Thus, a preferred radiographic element satisfying the requirements of the invention exhibits the following structure:

| |
|---|
| Surface Overcoat |
| Interlayer |
| Radiation-sensitive Emulsion Layer(s) |
| Transparent Film Support |
| Pelloid |
| Interlayer |
| Surface Overcoat |

(II)

When the element is intended to be imagewise exposed concurrently from both sides, as occurs when a dual-coated radiographic element is mounted between a pair of light-emitting intensifying screens, in the simplest possible construction, both the front and back colloid layer units contain a single radiation-sensitive silver halide emulsion layer and one other non-image forming hydrophilic colloid layer.

In practice it is usually preferred to construct the dual-coated radiographic element as follows:

| |
|---|
| Surface Overcoat |
| Interlayer |
| Radiation-sensitive Emulsion Layer(s) |
| Crossover Control Layer |
| Transparent Film Support |
| Crossover Control Layer |
| Radiation-sensitive Emulsion Layer(s) |
| Interlayer |
| Surface Overcoat |

(III)

The surface overcoats and the interlayers can be omitted from all of the constructions above. The pelloid and crossover control layers can be omitted with a loss in image sharpness. When at least two radiation-sensitive emulsion layers are present on one side of a dual-coated radiographic element, loss of image sharpness can be minimized by incorporating the crossover control function within the emulsion layer coated nearest the support, as illustrated by Dickerson U.S. Pat. No. 5,576,156.

All of the varied support and layer arrangements described above are conventional and fully compatible with the elements of the invention.

In the present invention all of the radiation-sensitive image forming silver halide emulsions, whether in one or a plurality of layers, coated on one or both sides of the support, are very thin tabular grain emulsions. The tabular grain emulsions (i) have a mean grain ECD of greater than 0.6 $\mu$m, (ii) have a mean tabular grain thickness of 0.10 $\mu$m or less, (iii) contain less than 3 mole percent iodide, based on silver, and (iv) are coated at a total silver coating coverage of less than 30 mg/dm$^2$. At these coating coverages the very thin tabular grain emulsions exhibit a only a limited capability of scattering infrared radiation in the wavelength range of from 850 to 1100 nm.

Very thin tabular grain silver halide emulsions contemplated for use in the practice of the invention can be of any of the following silver halide compositions: silver chloride, silver bromide, silver iodobromide, silver chlorobromide, silver bromochloride, silver iodochloride, silver iodochlorobromide and silver iodobromochloride, where the mixed halides are named in order of ascending concentrations. Since it is recognized that the presence of iodide slows grain development, it is advantageous to choose emulsions that contain no iodide or only limited levels of iodide. Iodide concentrations of less than 3 mole percent, based on silver, are specifically preferred. Of the three photographic halides (chloride, bromide and iodide), silver chloride has the highest solubility and hence lends itself to achieving the highest rates of development and is therefore preferred for the shortest rapid access processing cycles. When imaging speed and processing rates are considered together, silver chlorobromide and silver bromide compositions are preferred.

Conventional high (greater than 50 mole percent) chloride very thin tabular grain emulsions compatible with requirements of the radiographic elements of this invention are illustrated by the following citations, here incorporated by reference:

Maskasky U.S. Pat. No. 4,400,463;
Maskasky U.S. Pat. No. 4,713,323;
Takada et al U.S. Pat. No. 4,783,398;
Nishikawa et al U.S. Pat. No. 4,952,491;
Ishiguro et al U.S. Pat. No. 4,983,508;
Tufano et al U.S. Pat. No. 4,804,621;
Maskasky U.S. Pat. No. 5,061,617;
Maskasky U.S. Pat. No. 5,178,997;
Maskasky and Chang U.S. Pat. No. 5,178,998;
Maskasky U.S. Pat. No. 5,183,732;
Maskasky U.S. Pat. No. 5,185,239;
Maskasky U.S. Pat. No. 5,217,858;
Chang et al U.S. Pat. No. 5,252,452;
Maskasky U.S. Pat. No. 5,264,337;
Maskasky U.S. Pat. No. 5,272,052;
Maskasky U.S. Pat. No. 5,275,930;
Maskasky U.S. Pat. No. 5,292,632;
Maskasky U.S. Pat. No. 5,298,387;
Maskasky U.S. Pat. No. 5,298,388; and
House et al U.S. Pat. No. 5,320,938.

Conventional high (greater than 50 mole percent) bromide very thin tabular grain emulsions compatible with requirements of the radiographic elements of this invention are illustrated by the following citations, here incorporated by reference:

Abbott et al U.S. Pat. No. 4,425,425;
Abbott et al U.S. Pat. No. 4,425,426;
Kofron et al U.S. Pat. No. 4,439,520;
Maskasky U.S. Pat. No. 4,713,320;
Nottorf U.S. Pat. No. 4,722,886;
Saito et al U.S. Pat. No. 4,797,354;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Daubendiek et al U.S. Pat. No. 4,914,014;
Aida et al U.S. Pat. No. 4,962,015;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Black et al U.S. Pat. No. 5,219,720;
Antoniades et al U.S. Pat. No. 5,250,403;
Dickerson et al U.S. Pat. No. 5,252,443;
Tsaur et al U.S. Pat. No. 5,272,048;
Delton U.S. Pat. No. 5,310,644;
Chaffee et al U.S. Pat. No. 5,358,840;
Delton U.S. Pat. No. 5,372,927;
Delton U.S. Pat. No. 5,460,934;
Daubendiek et al U.S. Pat. No. 5,494,789;
Olm et al U.S. Pat. No. 5,503,970;
Daubendiek et al U.S. Pat. No. 5,503,971;
Daubendiek et al U.S. Pat. No. 5,573,902;

Daubendiek et al U.S. Pat. No. 5,576,168;

Olm et al U.S. Pat. No. 5,576,171;

Deaton et al U.S. Pat. No. 5,582,965; and

Wilson et al U.S. Pat. No. 5,614,358.

The very thin tabular grain emulsions useful in radiography are those that have an average equivalent circular diameter (ECD) of greater than 0.6 μm, to insure adequate speed, and less than 10 μm, to limit granularity. Preferred high speed tabular grain emulsion have a mean grain ECD of at least 1.0 μm. Typically the average ECD of the grains is 5 μm or less. The emulsions can be polydisperse or monodisperse, depending upon the specific imaging application contemplated. It is generally preferred that the coefficient of variation (COV) of grain ECD be less than 25 percent. For high contrast imaging, a COV of less than 10 percent is contemplated. COV is defined as the standard deviation of grain ECD divided by average ECD.

The silver coating coverages of all the radiation-sensitive image forming very thin tabular grain emulsions, whether present in one or more emulsion layers and whether coated on one or both sides of the support, is less than 30 mg/dm$^2$. As coating coverages decrease below 30 mg/dm$^2$, the detectability of the radiographic elements decreases. Thus, radiographic elements according to this invention having tabular grain emulsion total silver coating coverages of less than 25 mg/dm$^2$ and less than 20 mg/dm$^2$ are specifically contemplated. Useful silver images can be produced with silver coverages of radiation-sensitive grains down to 10 mg/dm$^2$, with coating coverages higher than 15 mg/dm$^2$ being most common.

The detectability of the radiation-sensitive image forming very thin tabular grain emulsions by infrared sensors in the 850 to 1100 nm wavelength range is also a function of (1) the mean thickness of the tabular grains and (2) the halide composition of the grains. At equal silver coating coverages and identical halide compositions, tabular grains become increasingly difficult to detect as their thickness decreases. Thus, the invention is particularly applicable to very thin (0.10 μm and less) and ultrathin (0.07 μm and less) tabular grain emulsions. When coating coverages and tabular grain thicknesses are held constant, increasing the proportion of the tabular grain chloride in relation to bromide increases the difficulty of detecting the radiographic elements. The inclusion of iodide, at contemplated concentrations of up to 3 mole percent, based on silver, has no significant impact on the light scattering properties of silver iodobromide grains, but the inclusion of iodide can significantly increase the light scattering of silver iodochloride grains.

The radiation-sensitive image forming emulsions are conventionally chemically sensitized and, when exposed to light, which occurs when photodiodes, lasers, CRT screens, or intensifying screens are employed for exposure, these emulsions are usually also spectrally sensitized. High bromide grains, particularly those containing iodide, exhibit significant native blue sensitivity, but no significant green or red sensitivity. Since the most commonly used intensifying screens emit in the green and the most commonly used photodiodes and lasers emit in the red, in most instances the radiation-sensitive grains are spectrally sensitized. Even when the grains possess native blue sensitivity and are exposed to blue light, further speed enhancements are realized when blue spectral sensitizing dyes are employed. Preferred chemical and spectral sensitizations are disclosed in *Research Disclosure*, Item 38957, cited above, Section IV. Chemical sensitization and Section V. Spectral sensitization and desensitization.

To increase the specular density of the elements of the invention so that near infrared sensors can detect the presence of the elements in rapid access processors, it is contemplated to incorporate in the elements compact particles (a) removable from the element during the reference processing cycle, (b) having a mean size of from 0.3 to 1.1 μm, and (c) having an index of refraction at the wavelength of the infrared radiation that differs from the index of refraction of the hydrophilic colloid by at least 0.2.

The optimum mean particle size for scattering near infrared radiation in the sensor wavelength range is approximately 0.7 μm, but acceptable scattering is realized over the entire range of from 0.3 to 1.9 μm. A preferred particle size range for near infrared scattering is from 0.5 to 0.9 μm. To insure more efficient near infrared scattering than the very thin tabular grains, it is contemplated to chose compact particles, since these particles are randomly spatially oriented within the hydrophilic colloid layers.

The ability of the compact particles to increase the specular density of the elements of the invention to near infrared radiation is in part a function of the mean size of the particles and in part determined by the mismatch, in the infrared wavelength region employed by the sensors, between the refractive indices the particles and the organic vehicle of the hydrophilic colloid layers in which they are dispersed. Organic vehicles and hardeners useful in the hydrophilic colloid layers of silver halide imaging elements are illustrated in *Research Disclosure*, Item 38957, cited above, Section II. Vehicles, vehicle extenders, vehicle-like addenda. The most commonly employed vehicles in silver halide imaging elements are gelatin, including pigskin gelatin as well as cattle bone and hide gelatin, and gelatin derivatives, such as acetylated or phthalated gelatin. Section II further lists a wide variety of organic materials employed in place of or, more typically, in combination with gelatino-vehicle. These organic vehicles typically have refractive indices in the range from about 1.40 to 1.75, most commonly 1.40 to 1.60. The refractive index of gelatin is generally 1.54.

To facilitate scattering of the near infrared sensor beam it is contemplated to employ particles that exhibit a refractive index difference, as compared to the vehicle, of at least 0.2 and preferably at least 0.4. The higher the refractive index difference, the larger the degree of near infrared scattering. Thus, there is no reason for intentionally limiting the refractive index difference.

Since the compact particles are intended to scatter infrared radiation, it was surprising that in the concentration ranges contemplated they do not unobjectionably degrade image sharpness when the radiographic elements are imagewise exposed by intensifying screen, photodiode or laser light emission. Although it was initially believed that the compact particles should be located behind the tabular grain emulsion or emulsions during exposure to avoid degrading image sharpness, it has now been recognized that the compact particles can be coated in any hydrophilic colloid layer or layers of the radiographic element other than the emulsion layer or layers without any significant impact on image sharpness. Thus, the compact particles can be coated in any one or combination of non-imaging hydrophilic colloid layers—i.e., the hydrophilic colloid layers other than emulsion layers.

For reasons that are not fully understood, the compact particles increase the optical density of the radiographic elements to infrared radiation to a greater degree when they are located in a hydrophilic colloid layer, such as crossover control or antihalation layer, that receives imaging radiation after it has passed through at least one very thin tabular grain emulsion layer. This advantage is demonstrated in the Examples below. If desired, the particles can be chosen from among those that exhibit significant infrared absorption when coated in crossover control or antihalation layers or in any other hydrophilic colloid layer that is located behind the emulsion layer or layers during imagewise exposure.

A wide variety of materials are known that can be prepared in the indicated particle size range and exhibit refractive indices that differ from that of the vehicle present in the hydrophilic colloid layer. Of these materials, those that are removable during the reference processing cycle are specifically selected. If the particles remain in the film permanently, the image bearing element has an undesirable hazy appearance. A simple illustration of haze is provided by placing a newspaper behind an imaged film and attempting to read the text through the film. The newsprint can be read through a film exhibiting low haze, but can be read, if at all, only with difficulty through a hazy film.

In one form the particles are comprised of silver halide. Since the particles are not employed for latent image formation, they need not be and preferably are neither chemically nor spectrally sensitized. The silver halide particles can be chosen from among any of the silver halide compositions disclosed above in connection with the radiation-sensitive grains. As in the case of the grains, iodide in the silver halide particles is limited to 3 (preferably 1) mole percent or less, based on silver, to facilitate removal of the particles by fixing during rapid access processing. If the silver halide particles remain in the element after processing, they may printout when the element is placed on a light box for viewing, thereby objectionably raising minimum density. Since there is no advantage to iodide inclusion in the particles, it is specifically preferred that it be entirely eliminated or present in only impurity concentrations.

If very rapid processing is contemplated, requiring high chloride silver halide radiation-sensitive grains, then the elements can also benefit by choosing high chloride silver halide particles.

In considering the choice of silver halides to form the particles, the refractive indices of the various halides should be taken into account. The refractive index of AgCl is 2.07, of AgBr is 2.25, and of AgI is 2.22. The refractive index between the hydrophilic colloid vehicle and silver bromide particles is nearly 0.2 higher than between the vehicle and silver chloride particles. The addition of iodide increases the refractive index of high chloride particles, but does not increase the refractive index of high bromide particles. From the foregoing it is apparent that high bromide particles lacking iodide, particularly silver bromide particles, are preferred for all elements, except those intended for the most rapid processing.

Instead of employing silver halide particles, other silver salts known to be alternatives to silver halide can be employed in combination with or in place of silver halide to form the particles. Other useful silver salts for forming particles can be chosen from among silver salts such as silver thiocyanate, silver phosphate, silver cyanide, silver citrate and silver carbonate. The compatibility of these silver salts with silver halide emulsions and processing is illustrated by Berriman U.S. Pat. No. 3,367,778, Maskasky U.S. Pat. Nos. 4,435,501, 4,463,087, 4,471,050 and 5,061,617, Ikeda et al U.S. Pat. No. 4,921,784, Brust et al U.S. Pat. No. 5,395,746 and *Research Disclosure*, Vol. 181, May 1979, Item 18153. These silver salt containing particles have the advantages of being (a) readily available, (b) environmentally acceptable, (c) chemically stable, and (d) compatible with silver halide imaging. There are, of course, a wide variety of other particle materials that can be substituted, but with some reduction of one or more of advantageous characteristics (a) through (d). There is, of course, no reason to employ materials, such as organic dyes or pigments, that are comparatively expensive or burdensome to prepare.

Any threshold amount of the particles that detectably increase specular density to near infrared radiation in the 850 to 1100 nm wavelength range can be employed. The amount required to raise the specular density of the element to the level of detectability by processor sensors will vary, depending on the level of specular density which the radiation-sensitive grains provide. Since the particles are more efficient in scattering near infrared radiation than very thin tabular grains, it can be appreciated that, in all instances, the elements are detectable to processor sensors at particle coating coverages of 30 mg/dm$^2$. Typical preferred particle coating coverages are contemplated to be in the range of from about 0.5 to 15 mg/dm$^2$, most preferably in the range of from 1.0 to 10 mg/dm$^2$.

A convenient location for placing the particles is in the surface overcoat or interlayer overlying the very thin tabular grain emulsion layer or layers. This location facilitates removal of the particles during rapid access processing. It is, of course, recognized that crossover control layers are useful sites for particle location in dual-coated elements. In single-sided elements (those in which the image forming emulsion layer or layers are confined to one side of the support) the particles can be located in any layer on the back side of the support. When more than one hydrophilic colloid layer other than emulsion layers are present in a radiographic element, it is possible to distribute the particles among the various other hydrophilic colloid layers in any desired manner. For example, with particles that are more difficult to remove during processing than silver halide, the particles can be distributed between surface layers on both sides of the support to maximize processing solution contact.

Conventional hydrophilic colloid vehicle coating coverages are compatible with the element structures of the invention. Dickerson et al U.S. Pat. No. 4,900,652 teaches rapid access processing with hydrophilic colloid coverages per side of less than 65 mg/dm$^2$, preferably less than 45 mg/dm$^2$. Conveniently hydrophilic colloid coverages on any one side of the support can range as low the combined coating coverages of the radiation-sensitive grains and the particles incorporated on that one side. In the preferred element constructions II and III (including a and b variants) hydrophilic colloid coatings are present on both the front and back sides of the support. By providing at least approximately similar hydrophilic colloid coverages on the opposite sides of the support, the elements are protected from curl. When a support is sufficiently rigid to resist curl or curl is otherwise controlled, the hydrophilic colloid layers can be coated entirely on one side of the support.

Instability which increases minimum density in negative-type emulsion coatings (i.e., fog) can be protected against by incorporation of stabilizers, antifoggants, antikinking agents, latent-image stabilizers and similar addenda in the emulsion and contiguous layers prior to coating. Such addenda are illustrated by *Research Disclosure*, Item 38957, Section VII. Antifoggants and stabilizers, and Item 18431, Section II. Emulsion Stabilizers, Antifoggants and Antikinking Agents.

The surface overcoats are typically provided for physical protection of the emulsion and pelloid layers. In addition to vehicle features discussed above the overcoats can contain various addenda to modify the physical properties of the overcoats. Such addenda are illustrated by *Research Disclosure*, Item 38957, IX. Coating physical property modifying addenda, A. Coating aids, B. Plasticizers and lubricants, C. Antistats, and D. Matting agents. The interlayers arc typically thin hydrophilic colloid layers that provide a separation between the emulsion or pelloid (particularly the former) and the surface overcoat addenda.

The pelloid layer is a preferred location for antihalation dyes. Such dyes are illustrated by *Research Disclosure*, Item 38957, Section VIII. Absorbing and scattering materials, B. Absorbing materials. The antihalation dyes absorb light that has passed through the emulsion layer to minimize light reflection and the associated reduction in image sharpness. Antihalation dyes are chosen to be decolorized during processing.

When an antihalation dye is coated between an emulsion layer and the support, it performs the same function as when coated on the back side of the support. When radiation-sensitive silver halide grains are coated on only one side of the support, increased processing rates are realized when the antihalation dye is contained on the opposite side of the support. When an element is dual coated, such as element III, the dyes used as antihalation dyes are also useful to control crossover.

EXAMPLES

The invention can be better appreciated by reference to the following specific embodiments. Coating coverages in units of mg/dm$^2$ are shown in parenthesis ( ) and in units of mg/ft$^2$ are shown in brackets []. Silver halide coating coverages are reported in terms of silver. Mean grain size, including mean thickness for tabular grain emulsions, is reported in units of $\mu$m and enclosed in braces {}.

Element A (a control)

The following element was constructed:

| |
|---|
| SOC Layer |
| Interlayer |
| Emulsion Layer |
| Blue 7 mil (178 $\mu$m) Estar ™ Support |
| Emulsion Layer |
| Interlayer |
| SOC Layer |

Estar™ is poly(ethylene terephthalate)
SOC Layer
gelatin [32.0] (3.4)
poly(methyl methacrylate) matte [1.3] (0.14)
carboxymethyl casein [5.3] (0.57)
colloidal silica [5.3] (0.57)
polyacrylamide [5.3] (0.57)
chrome alum [0.23] (0.025)
resorcinol [0.54] (0.058)
whale oil lubricant [1.34] (0.15)
Interlayer
gelatin [32.0] (3.4)
Al Lippmann {0.08} [1.0] (0.11)
carboxymethyl casein [5.3] (0.57)
colloidal silica [5.3] (0.57)
polyacrylamide [5.3] (0.57)
chrome alum [0.23] (0.025)
resorcinol [0.54] (0.058)
nitron [0.41] (0.044)

The Lippmann emulsion exhibited a grain size much too low to scatter infrared radiation; accordingly, its silver content is excluded from silver coating coverages reported below.

Emulsion Layer
AgBr {1.8 ECD X 0.13 t} [170] (18.3)
gelatin [290] (31.2)
4-hydroxy-6-methyl-1,3,3a,7-tetraazaindene 2.1 g/Ag mole
potassium nitrate [16.9] (1.8)
ammonium hexachloropalladate [0.02] (0.002)
maleic acid hydrazide [0.08] (0.087)
sorbitol [4.88] (0.53)
glycerin [5.331] (0.57)
potassium bromide [1.27] (0.14)
resorcinol [4.10] (0.44)
bis(vinylsulfonylmethyl)ether 2.4%
(based on wt. of gelatin in all layers)

The tabular grain emulsion, indicated as AgBr above, was sulfur and gold sensitized and spectrally sensitized with 400 mg/Ag mole of anhydro-5,5-dichloro-9-ethyl-3,3'-bis(3-sulfopropyl)oxacarbocyanine hydroxide (Dye SS1), followed by the addition of 300 mg/Ag mole of KI.

Element B (a control)

This element was identical to Element A, except for a somewhat varied construction of the emulsion layers. Of the emulsion layer variations, the approximate halving of the silver coating coverage was the only difference of significance in terms of demonstrating infrared scattering.

Emulsion Layer
AgBr {2.0 ECD X 0.13 t} [90] (9.7)
gelatin [70] (7.5)
4-hydroxy-6-methyl-1,3,3a,7-tetraazaindene 2.1 g/Ag mole
4-hydroxy-6-methyl-2-methyl-mercapto-1,3,3a,7-tetraazaindene 400 mg/Ag mole
2-mercapto-1,3-benzothiazole 30 mg/Ag mole
potassium nitrate [16.9] (1.8)
ammonium hexachloropalladate [0.02] (0.002)
maleic acid hydrazide [0.08] (0.087)
sorbitol [4.88] (0.53)
glycerin [5.33] (0.57)
potassium bromide [1.27] (0.14)
resorcinol [4.10] (0.44)
dextran [20.00] (2.2)
polyacrylamide [7.4] (0.80)
carboxymethyl casein [4.5] (0.48)
bis(vinylsulfonylmethyl)ether 0.4%
(based on wt. of gelatin in all layers)

The tabular grain emulsion was chemically and spectrally sensitized similarly as Emulsion A.

Element C (a control)

This element was constructed similarly as element B, except that the mean thickness of the tabular grains was reduced to 0.10 $\mu$m. The thinner tabular grain emulsion was chemically and spectrally sensitized similarly as Emulsion A, except that the dye level was increased to 590 mg/Ag mole and the KI level was increased to 400 mg/Ag, to reflect the higher surface area provided by the thinner tabular grains.

Element D (a control)

This element was constructed similarly as element C, except that the mean thickness of the tabular grains was reduced to 0.07 μm. The thinner tabular grain emulsion was chemically and spectrally sensitized similarly as Emulsion A, except that the dye level was increased to 1400 mg/Ag mole and the KI level was increased to 600 mg/Ag, to reflect the higher surface area provided by the thinner tabular grains.

Testing

Samples of Elements A through D were exposed through a graduated density step tablet to a MacBeth™ sensitometer for 1/50th second to a 500 watt General Electric DMX projector lamp calibrated to 2650° K, filtered with a Corning C4010 filter to simulate a green emitting intensifying screen exposure. Processing was conducted using a Kodak X-OMAT M6A-N™ processor, using the processing cycle, developer and fixer, previously described as the reference processing cycle. Before processing, samples the elements were scanned with 942 nm laser to determine infrared density at the time of introduction into the rapid access processor.

The results are summarized in Table I below:

TABLE I

| Element | Total Silver (mg/dm$^2$) | Mean Tabular Grain Thickness μm | IR Specular Density |
|---|---|---|---|
| A | 36.6 | 0.13 | 1.068 |
| B | 18.7 | 0.13 | 0.902 |
| C | 18.7 | 0.10 | 0.833 |
| D | 18.7 | 0.07 | 0.645 |

From Table I it is apparent that both the total silver coverage and the thickness of the tabular grains have an influence on infrared specular density. Elements C and D were judged to lack sufficient to IR specular density to be detected reliably by the IR sensors of the rapid access processor.

Element E (an example)

This element was identical to element C, except that 0.8 mg/dm$^2$ of 0.8 μm compact particles (AgBr cubic grains) were added to the interlayer on each side of the support.

Element F (an example)

This element was identical to element C, except that 1.6 mg/dm$^2$ of 0.8 μm compact particles (AgBr cubic grains) were added to the interlayer on each side of the support.

Element G (an example)

This element was identical to element D, except that 1.6 mg/dm$^2$ of 0.8 μm compact particles (AgBr cubic grains) were added to the interlayer on each side of the support.

Testing

Testing was conducted as previously described. The results are summarized in Table II.

TABLE II

| Element | Particle Silver (mg/dm$^2$) | Mean Tabular Grain Thickness μm | IR Specular Density |
|---|---|---|---|
| E | 1.6 | 0.10 | 0.959 |
| F | 3.2 | 0.10 | 1.097 |
| G | 3.2 | 0.07 | 0.951 |

From Table II it is apparent that the addition of compact particles of a size chosen to exhibit efficient IR radiation scattering transformed elements otherwise similar to non-detectable elements C and D into elements having sufficient infrared specular density to be reliably detected in a rapid access processor. Note that about twice the level of compact particles was required to increase the IR specular density of element G (mean tabular grain thickness 0.07 μm) to that of element E (mean tabular grain thickness 0.10 μm).

Elements H, I and J (controls)

Elements H, I and J were similar to elements B, C and D, respectively, except that on each side of the support 7.5 mg/dm$^2$ of gelatin was coated as a layer interposed between the support (hereinafter referred to as the interposed layer) and the emulsion layer.

Testing

Testing was conducted as previously described. The results are summarized in Table III.

TABLE III

| Element | Particle Silver (mg/dm$^2$) | Mean Tabular Grain Thickness μm | IR Specular Density |
|---|---|---|---|
| H | none | 0.13 | 1.035 |
| I | none | 0.10 | 0.858 |
| J | none | 0.07 | 0.819 |

Only element I exhibited sufficient specular density to infrared radiation to be reliably detected in the processor. Notice that specular IR density decreased as the mean thickness of the tabular grains decreased. In all other respects elements H, I and J were identical.

Element K (an example)

This element was identical to element I, except that 0.8 mg/dm$^2$ of 0.8 μm compact particles (AgBr cubic grains) were added to the interposed on each side of the support.

Element L (an example)

This element was identical to element I, except that 1.6 mg/dm$^2$ of 0.8 μm compact particles (AgBr cubic grains) were added to the interposed layer on each side of the support.

Element M (an example)

This element was identical to element J, except that 1.6 mg/dm$^2$ of 0.8 μm compact particles (AgBr cubic grains) were added to the interposed layer on each side of the support.

Element N (an example)

This element was identical to element J, except that 3.2 mg/dm$^2$ of 0.8 $\mu$m compact particles (AgBr cubic grains) were added to the interposed layer on each side of the support.

Testing

Testing was conducted as previously described. The results are summarized in Table IV.

TABLE IV

| Element | Particle Silver (mg/dm$^2$) | Mean Tabular Grain Thickness $\mu$m | IR Specular Density |
|---|---|---|---|
| K | 1.6 | 0.10 | 1.000 |
| L | 3.2 | 0.10 | 1.133 |
| M | 3.2 | 0.07 | 1.060 |
| N | 6.4 | 0.07 | 1.306 |

From Table IV it is apparent that the addition of compact particles to the interposed layer increased specular IR density to levels well above minimum requirements for detection in a rapid access processor.

By comparing otherwise identical elements differing solely by the location of the compact particles, it is apparent that higher specular densities were observed from the interposed layer (IPL) site than from the interlayer (IL) site. This comparison is shown in Table V.

TABLE V

| Element | Particle Silver (mg/dm$^2$) | Mean Tabular Grain Thickness $\mu$m | Location | IR Specular Density |
|---|---|---|---|---|
| E | 1.6 | 0.10 | IL | 0.959 |
| K | 1.6 | 0.10 | IPL | 1.000 |
| F | 3.2 | 0.10 | IL | 1.097 |
| L | 3.2 | 0.10 | IPL | 1.133 |
| G | 3.2 | 0.07 | IL | 0.951 |
| M | 3.2 | 0.07 | IPL | 1.060 |

The invention has been described in detail with particular reference to preferred embodiments thereof, but it will be understood that variations and modifications can be effected within the spirit and scope of the invention.

What is claimed is:

1. A radiographic element comprised of a transparent film support and, coated on the support, hydrophilic colloid layers, including (a) one or more radiation-sensitive image forming tabular grain emulsion layers (i) having a mean grain equivalent circular diameter of greater than 0.6 $\mu$m, (ii) containing less than 3 mole percent iodide, based on silver, (iii) having a mean tabular grain thickness of 0.10 $\mu$m or less, and (iv) coated at a total silver coating coverage of less than 30 mg/dm$^2$, and (b) one or more other hydrophilic colloid layers, WHEREIN the specular density of the element to infrared radiation in the wavelength range of from 850 to 1100 nm is increased by the presence of compact particles dispersed in at least one of the other hydrophilic colloid layers, said particles (a) being removable from the element during the reference processing cycle, (b) having a mean equivalent circular diameter of from 0.3 to 1.1 $\mu$m, and (c) having an index of refraction at the wavelength of the infrared radiation that differs from the index of refraction of the hydrophilic colloid by at least 0.2, said reference processing cycle consisting of development 24 seconds at 35° C.
fixing 20 seconds at 35° C.
washing 20 seconds at 35° C.
drying 20 seconds at 65° C.

with up to 6 seconds being taken up in film transport between processing steps, development employing the following composition:

hydroquinone 30 g
1-phenyl-3-pyrazolidone 1.5 g
KOH 21 g
$NaHCO_3$ 7.5 g
$K_2SO_3$ 44.2 g
$Na_2S_2O_3$ 12.6 g
NaBr 35.0 g
5-methylbenzotriazole 0.06 g
glutaraldehyde 4.9 g
water to 1 liter at a pH 10.0, and fixing employing the following composition:

$Na_2S_2O_3$ in water at 60% of total weight 260.0 g
$NaHSO_3$ 180.0 g
boric acid 25.0 g
acetic acid 10.0 g
water to 1 liter at a pH of 3.9–4.5.

2. A radiographic element according to claim 1 wherein the support has front and back major faces and the hydrophilic colloid layers are coated on both the front and back major faces with at least one of the tabular grain emulsion layers being coated on each of the major faces of the support.

3. A radiographic element according to claim 1 wherein at least a portion of the compact particles are present in a hydrophilic colloid layer interposed between one of the tabular grain emulsion layers and the support.

4. A radiographic element according to claim 1 wherein at least a portion of the compact particles are present in a hydrophilic colloid layer that overlies one of the tabular grain emulsion layers.

5. A radiographic element according to claim 1 wherein the tabular grain emulsions are coated at total silver coating coverage of less than 25 mg/dm$^2$.

6. A radiographic element according to claim 5 wherein the tabular grain emulsions are coated at total silver coating coverage of from 20 to 15 mg/dm$^2$.

7. A radiographic element according to claim 1 wherein the particles exhibit a mean size in the range of from 0.5 to 0.9 $\mu$m.

8. A radiographic element according to claim 1 wherein the refractive index of the particles differs from that of the hydrophilic colloid in which the particles are dispersed by at least 0.4.

9. A radiographic element according to claim 1 wherein the particles are comprised of silver halide containing less than 3 mole percent iodide, based on silver.

10. A radiographic element according to claim 9 wherein the particles consist essentially of silver bromide.

* * * * *